United States Patent [19]

Weck

[11] Patent Number: 5,016,525

[45] Date of Patent: May 21, 1991

[54] AIR OUTLET FOR IMPARTING A SPIN FLOW TO AIR PASSING THERETHROUGH

[75] Inventor: Franz Weck, Herzogenrath, Fed. Rep. of Germany

[73] Assignee: H. Krantz GmbH & Co., Aachen, Fed. Rep. of Germany

[21] Appl. No.: 570,139

[22] Filed: Aug. 20, 1990

[30] Foreign Application Priority Data

Aug. 23, 1989 [DE] Fed. Rep. of Germany ... 8910061[U]

[51] Int. Cl.[5] ..... F24F 13/062

[52] U.S. Cl. ..... 98/40.12; 98/40.05

[58] Field of Search ..... 98/40.01, 40.05, 40.1, 98/40.12, 40.18, 40.2

[56] References Cited

FOREIGN PATENT DOCUMENTS

| | | | |
|---|---|---|---|
| 441438 | 12/1974 | U.S.S.R. | 98/40.01 |
| 531001 | 12/1976 | U.S.S.R. | 98/40.11 |
| 830082 | 5/1981 | U.S.S.R. | 98/40.01 |
| 883615 | 11/1981 | U.S.S.R. | 98/40.05 |

*Primary Examiner*—Harold Joyce

*Attorney, Agent, or Firm*—W. G. Fasse

[57] ABSTRACT

An air passage or outlet for imparting a spin flow to air passing therethrough, is economically produced of only two basic sheet metal components. The sheet metal has a good fire resistance capability and can be easily coated with an individual paint color. One sheet metal component is a sheet metal plate (4) with punched-out tongue-shaped air guide vanes (2) that are arranged at a spacing concentrically around a central axis perpendicular to the plane of the plate (4). A central hub area (3) remains connected to an outer area of plate (4) by spoke-type lands separating the air flow holes. The other sheet metal component of the air passage is a connector piece (5) having, e.g., a cylindrical neck (6) surrounded at its lower end by a collar (7). The inner diameter of the connector piece (5) is so dimensioned that radially outer edges of the guide vanes (2) are held in place by a press-fit against the inner sides of the cylindrical neck of the connector piece (5). The side of the sheet metal plate (4) facing the connector piece (5) bears rigidly against the edge of the neck (6) of the connector piece (5) when the two components are connected to each other.

14 Claims, 3 Drawing Sheets

AIR OUTLET FOR IMPARTING A SPIN FLOW TO AIR PASSING THERETHROUGH

FIELD OF THE INVENTION

The invention relates to an air outlet for imparting a spin flow to air passing therethrough. Guide vanes for causing the spin flow are arranged in the outlet concentrically around a central axis extending in the flow direction. A diffuser-type connector piece holds the guide vanes in place.

BACKGROUND INFORMATION

Such air outlets or air passages are generally known and are, for example, arranged in the ceiling area of a room that is to be ventilated and/or air conditioned. These outlets or passages are connected to air channel systems through which the air is supplied. The construction of these air passages or outlets imparts to the emerging air flow or jets a high spin impulse, whereby the exiting air is intensively mixed with the air of the room before reaching lower zones in a room, so that drafts are not noticeable by people present in said lower room zones.

Air passages as described above are quite reliable in their mode of operation. Further, these conventional air outlets are usually made of plastics material, preferably by injection molding, and are therefore relatively inexpensive. However, air passages of plastics material have two essential disadvantages. One disadvantage is seen in that plastic air passages lack adequate temperature stability, whereby the passages can even catch on fire, depending on the plastics material used in the construction. Another disadvantage is the fact that it is difficult to coat such plastic air passages with paint and therefore they can only be matched to the individual color scheme of a room by making special efforts and expenses.

OBJECTS OF THE INVENTION

In view of the foregoing it is the aim of the invention to achieve the following objects singly or in combination:

to provide an air passage or outlet as described above which is manufactured of sheet metal at least as economically as known air outlets made of plastics material;

to construct the components of such an outlet of fire-resistant sheet metal material;

to construct such air outlets of materials that are economically coatable with paint which lasts substantially permanently; and to minimize the number of parts, and hence tools, for producing such outlets.

SUMMARY OF THE INVENTION

According to the invention there is provided a spin flow air outlet comprising a plurality of sheet metal air guide vanes die-stamped out of a first sheet metal component. Each air guide vane has a radial edge bent out of the plane of the same sheet metal panel forming the first component. The first sheet metal component is secured to an outlet diffuser-type connector piece, preferably with a press-fit between radially outer circumferential edges of the air guide vanes and an inner surface of the connector piece which is also made as a second sheet metal component.

Only two sheet metal components are needed in the production of the air passage or outlet according to the invention. One of these sheet metal components is a panel or plate out of which the air guide vanes are cut along all edges, but one edge along which the respective air guide vane is bent out of the plane of the sheet metal plate. The other sheet metal component is also made of a sheet metal plate by rolling and pressing to form a connector piece to which the sheet metal panel or plate with the vanes is connected, e.g., by nesting the vanes with a press-fit in the outlet connector piece to form the air passage, preferably without any auxiliary connections, other than the press-fit, between the two sheet metal components.

When the sheet metal panel or plate with the guide vanes therein is inserted from above into the outlet connector also made of sheet metal, it is sufficient for the connection of the two structural elements, that the outer circumferential edges of the guide vanes press against the inner surface of a neck section of the sheet metal outlet connector. A small biasing force has been found to be sufficient for holding the two components together.

However, according to another embodiment of the invention, the connection of the two structural components can be further strengthened, in that each air guide vane has at least one protrusion or indentation on its radially outer edge at the circumference, whereby the protrustion or indentation of the guide vane engages an indentation or a protrusion on the inner side of the outlet connector piece. The protrusions can have a pointed shape and can engage in correspondingly shaped indentations or notches.

There is also the possibility of making openings or indentations in the sheet metal outlet connector piece and letting initially tongues or protrusions on the outer edges of the guide vanes protrude somewhat over the outer circumference of the sheet metal outlet connector so that these protrusions extend into and through said openings, whereupon they are bent over, e.g. at a right angle to form a type of riveted joint. A similar and advantageous connection can be formed by shaping the protrusions on the outer edges of the guide vanes as flat tongues protruding through the openings to be easily twisted on the outside of the sheet metal outlet connector.

Each of the above described connection means makes it possible to arrange both structural elements in such a manner that, according to a further embodiment of the invention, the side of the sheet metal panel out of which the guide vanes are cut and bent, lies rigidly against a front edge of the sheet metal outlet connector piece.

According to a further embodiment of the invention, a compact construction of the air passage or outlet is achieved in that the outer contour of the sheet metal panel extends in parallel to the outer contour of the sheet metal outlet connector piece and so that both contours are congruent with each other. The outer contour of the connector piece may be formed as a collar. Air passages or outlets constructed in such a manner have a block or disk shape that can be easily integrated in a cassette-type ceiling recess formed by a conventional ceiling grid structure.

The sheet metal outlet connector piece and the sheet metal panel can be circular or polygonal, without affecting the simplicity of the construction of the air passage. Welding spots may be used in addition to or instead of the above connecting means between the outlet connector piece and the panel having the air guide vanes therein.

According to an especially advantageous feature of the invention, at least two sheet metal panels with punched out guide vanes are arranged in series and rotated one relative to the other so that the guide vanes of one sheet metal panel reach into the punched-out holes of the guide vanes of the other panel, whereby both sets of guide vanes can fully overlap the holes out of which these guide vanes have been punched, as viewed in the projection direction. The just described feature of an angular displacement of one set of guide vanes relative to another set of guide vanes is advantageous for an improved efficiency. Without such angular guide vane displacement the larger openings are not fully covered by the projections of the guide vanes formed in the sheet metal panel due to the inclination of the tongue-shaped guide vanes. It has been found that for normal requirements a sufficient spin is imparted to the air flow by one set of guide vanes. However, for certain purposes two sets of guide vanes angularly displaced relative to each other may be desirable.

Since the sheet metal panels with guide vanes of the same shape and arrangement can be fitted or nested into one another, only rotation at an angle that is smaller than the angle between two neighboring guide vanes of the sheet metal panel around its axis perpendicular to the panel surface, is necessary to completely overlap all of the openings by the projection of the guide vanes.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
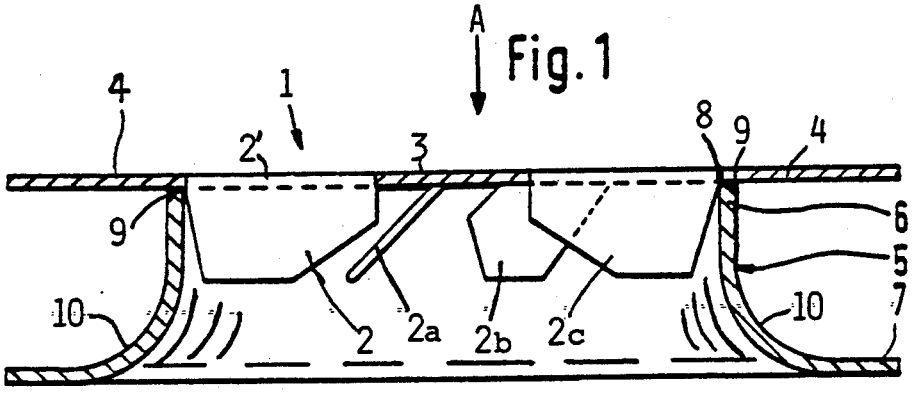
FIG. 1 is a sectional view along section line 1—1 in FIG. 2, through a rectangular air passage with a circular arrangement of the air guide vanes of the invention.
Figure 2:
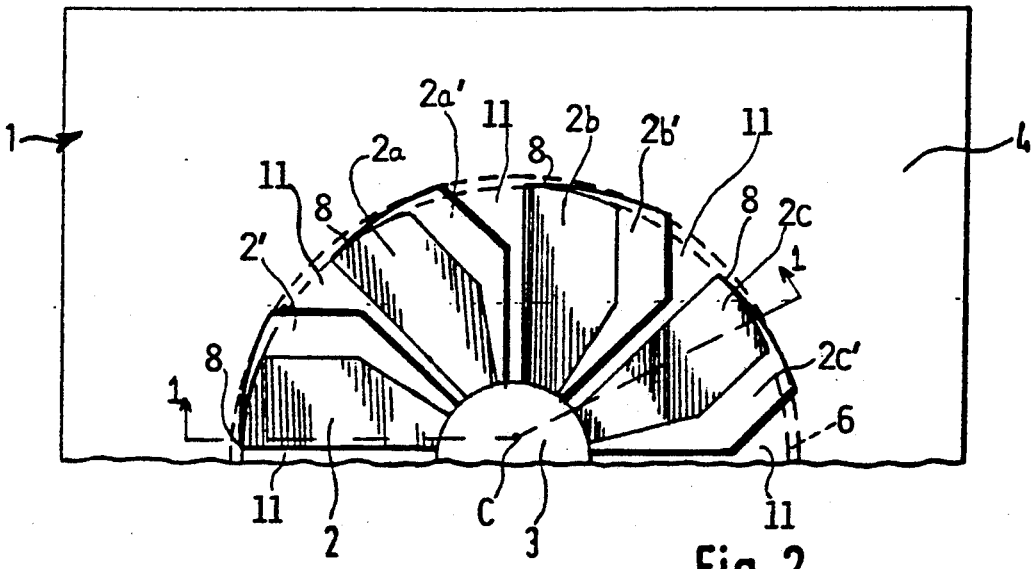
FIG. 2 shows a plan view on one half of the air passage of FIG. 1, as viewed in the direction of the arrow A showing the flow direction in FIG. 1.

As shown in FIG. 1, the present air passage or outlet 1 comprises a sheet metal plate 4 with punched-out tongue-shaped guide vanes 2, 2*a*, 2*b*, and 2*c* arranged at a uniform angular spacing concentrically around a central axis C extending perpendicularly to the plane of the plate 4. The terms "outlet" and "passage" are used as synonyms of each other. A central hub area 3 and an outer area of the plate 4 are maintained unchanged by the punching-out process, whereby spoke-type hands 11 remain to connect the area 3 with the plate 4. The guide vanes are simply bent out of the plane of the plate 4 at a suitable bending angle relative to the plate 1, for imparting a spin flow to an air stream flowing toward the plate 4 in the direction of the arrow A, when the air passes through the holes 2', 2*a*', 2*b*', and 2*c*', which resulted from the punching and bending of the respective guide vanes, as best seen in FIG. 2.

Further, the air passage comprises a sheet metal connector piece 5 with a cylindrical neck section 6 having an inner radius such that radially outer circumferential edges of the guide vanes fit with a press-fit at 8 into the cylindrical neck section 6 when the upper edge of the cylindrical section of the connector piece 5 is pressed against the inner, downwardly facing side of the sheet metal plate 4, whereby the connector piece 5 and the sheet metal plate 4 are rigidly interconnected with each other. However, additional spot welding 9 may be used for the connection, if desired.

The connector piece 5 can be made of sheet metal or of a sheet metal pipe, whereby a collar 7 is formed by a rolling process. The collar 7 and the cylindrical neck section 6 preferably merge into each other along a curved neck section 10. Further, as shown in FIG. 1 the connector piece 5 has a diameter that increases in the flow direction to form a diffuser for the outflowing spin flow.

Both structural components 1 and 5 of the air passage of the invention can be economically produced in a punching-out and bending process, and for example, can be coated with a preferred individual color by an equally economical dipping into paint.

The quadrangular configuration of the outer area of the plate 4 of the air passage as shown in FIG. 2 makes it possible, for example, to integrate the present air passage in an architecturally advantageous manner in a cassette-shaped ceiling structure. Such a ceiling structure comprises conventionally a grid structure of supporting rails or bars carrying ceiling panels, covers for lighting fixtures, and the like. By dimensioning the plate 1 and the collar 7 in accordance with the grid opening dimensions, the present air outlets are easily integrated into such a ceiling structure.

Figure 3:
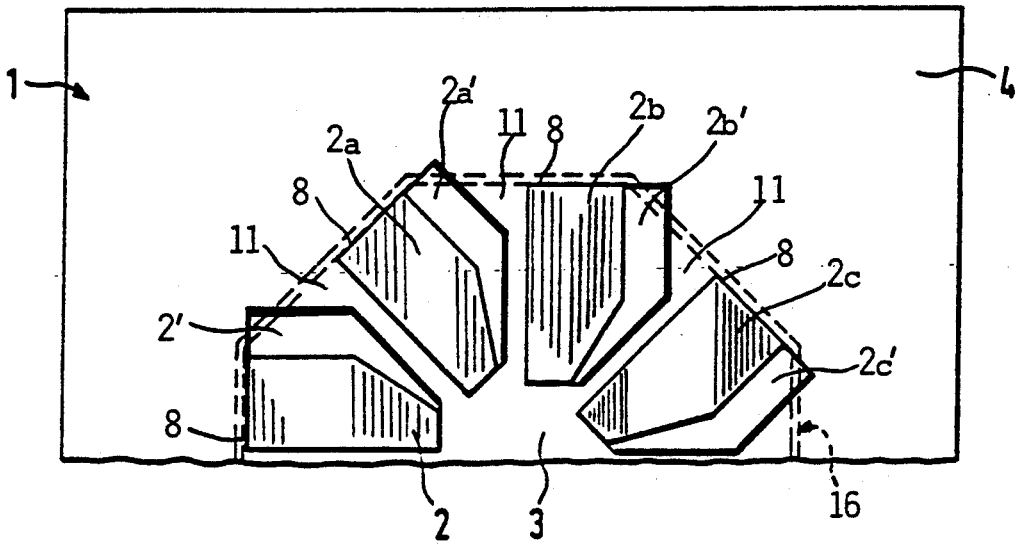
FIG. 3 shows a plan view similar to that of FIG. 2, of one half of an air passage with an octagonal arrangement of the air guide vanes.

FIG. 3 shows an embodiment in which the air guide vanes are arranged in an octagonal pattern. Connector 16 has an octagonal neck.

Figure 4:
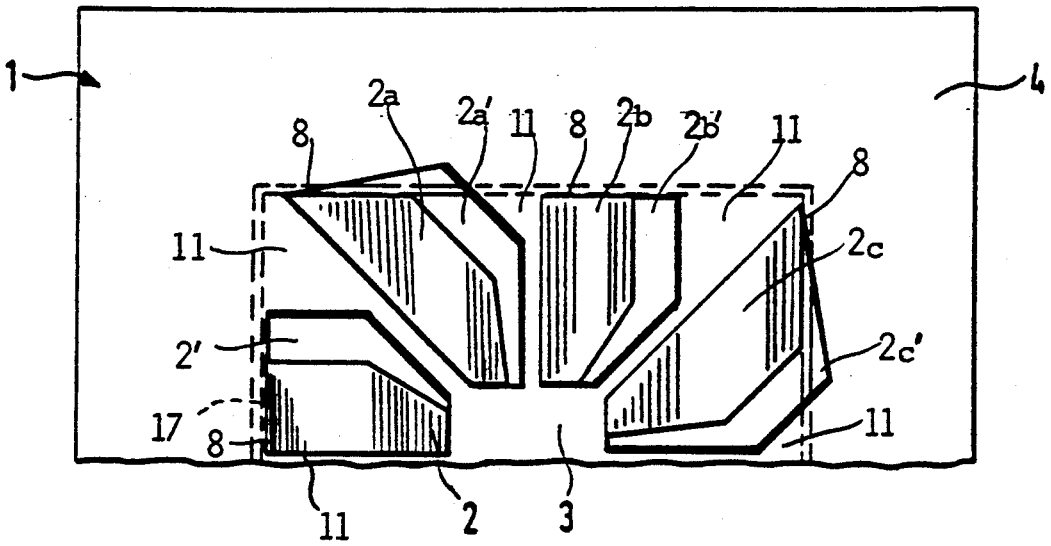
FIG. 4 shows a plan view similar to that of FIG. 2, of one half of an air passage with a quadrangular or square arrangement of the air guide vanes.

FIG. 4 shows an embodiment in which the air guide vanes are arranged in a square configuration. These configurations may be advantageous for integration with corresponding patterns of other ceiling components, such as ceiling panels. The neck of the connector piece 17 is also square.

Figure 5:
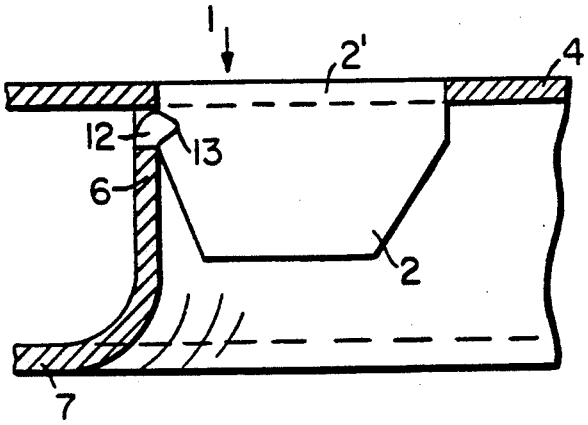
FIG. 5 shows another way of connecting the air guide vanes to the connector piece.

FIG. 5 shows another way of securing the plate 4 to the connector piece 5. Instead of a press-fit or a spot welding, the connection is accomplished by a tongue 12 bent out of the cylindrical neck 6 of the connector piece 5 and engaging a cut-out or notch 13 in the guide vane 2.

Figure 6:
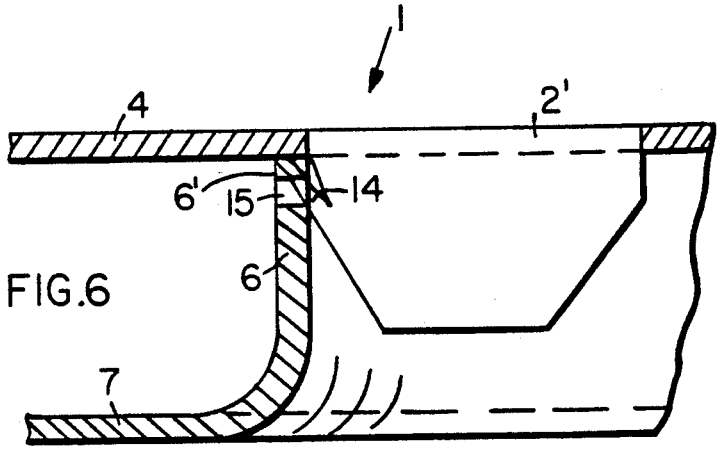
FIG. 6 shows yet another possibility of connecting the air guide vanes to the connector piece.

FIG. 6 shows still another connection between the plate 4 and guide vane 2 on the one hand and the neck 6 of the connector piece 5 on the other hand. An elastically yielding tongue 14 permits inserting the plate 4 with its guide vanes into the neck 6 of the connector piece 5. As soon as the tongues 14 have cleared the edge 6' they snap into holes 15 in the neck 6 just below the upper neck edge 6', thereby bearing against the neck edge 6'.

Figure 7:
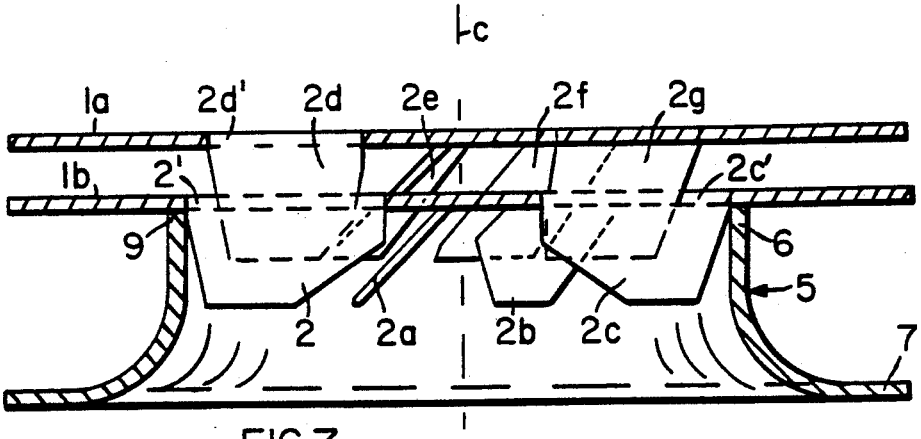
FIG. 7 is a view similar to FIG. 1, but showing two sets of guide vanes angularly displaced relative to one another.

FIG. 7 illustrates an embodiment in which two plates 1*a* and 1*b* cooperate with one connector piece 5. The guide vanes 2*d*, 2*e*, 2*f*, and 2*g* in the plate la are formed in the same way as the guide vanes 2, 2*a*, 2*b*, and 2*c* in plate 1*b*. However, the guide vanes 2*d*, 2*e*, 2*f*, and 2*g* in plate 1*a* are angularly rotated around a central axis C shown in FIG. 2 . Due to the angular displacement of the guide vanes in one plate relative to the guide vanes in the other plate, the holes 2', 2*a'*, 2*b'*, 2*c'* are covered by the projection of all guide vanes into the plane of the plate 1*b*. Additionally, the guide vanes of plate la may partially extend into the holes 2', 2*a'*, 2*b'*, 2*c'* in plate 1 for guiding the air into these holes. The air enters the holes 2*d'* in plate 1*a* as a straight flow and exits below the holes 2', 2*a'*, 2*b'*, 2*c'* as a spin flow.

Although the invention has been described with reference to specific example embodiments it will be appreciated that it is intended to cover all modifications and equivalents within the scope of the appended claims.

What I claim is:

1. An air outlet for imparting a spin flow to air passing through said outlet, comprising first means including a sheet metal plate having flow holes therein and air guide vanes cut and bent out of said sheet metal plate in a flow direction to form said flow holes and for causing said spin flow, second means including a sheet metal detector piece having a neck section and a collar section merging into said neck section, said air guide vanes extending into said neck section of said connector piece, and means securing said first means to said second means.

2. The air outlet of claim 1, wherein said securing means comprise a press-fit between at least one radially outer circumferential edge of said guide vanes and an inner surface of said neck section of said connector piece.

3. The air outlet of claim 1, wherein said securing means comprise a welding between at least one radially outer circumferential edge of said guide vanes and said neck section of said connector piece.

4. The air outlet of claim 1, wherein said securing means comprise a notch in at least one radially outer circumferential edge of said guide vanes, and a tongue in said neck section bent into said notch.

5. The air outlet of claim 1, wherein said securing means comprise at least one recess or hole in said neck section, and an elastic tongue in a radially outer circumferential edge of at least one of said guide vanes, said elastic tongue snapping into said recess or hole when said guide vanes are inserted into said neck section of said connector piece.

6. The air outlet of claim 1, wherein said neck section of said connector piece has a rim resting firmly against a surface of said sheet metal plate around said guide vanes when said guide vanes are inserted into said neck section.

7. The air outlet of claim 1, wherein said sheet metal plate and said collar have the same outer contour.

8. The air outlet of claim 1, wherein said outer contour is square, rectangular, polygonal or circular.

9. The air guide of claim 1, wherein said guide vanes are arranged in a square, rectangular, polygonal, or circular pattern.

10. The air outlet of claim 1, wherein said connector piece is a pipe of sheet metal construction.

11. The air outlet of claim 1, comprising a further sheet metal plate having flow holes therein and air guide vanes cut and bent out of said further sheet metal plate in a flow direction to form said flow holes and for causing a first spin flow, said further sheet metal plate extending in parallel to said first mentioned sheet metal plate at such a spacing that said guide vanes of said further sheet metal plate extend partly into said flow holes formed in said first mentioned sheet metal plate.

12. The air outlet of claim 11, wherein said guide vanes of said further sheet metal plate are angularly displaced relative to said guide vanes of said first mentioned sheet metal plate to such an angular extent, that all guide vanes together in their projection into the plane of the first mentioned sheet metal plate cover said flow holes in said first mentioned sheet metal plate.

13. The air outlet of claim 11, wherein said air guide vanes of said further sheet metal plate are angularly displaced relative to said air guide vanes in said first sheet metal plate, so that all air guide vanes together cover with their projections all flow holes in both sheet metal plates.

14. The air outlet of claim 1, wherein said sheet metal connector piece has a diameter increasing in the flow direction to form a diffuser.

* * * * *

UNITED STATES PATENT AND TRADEMARK OFFICE

CERTIFICATE OF CORRECTION

PATENT NO. : 5,016,525

DATED : May 21, 1991

INVENTOR(S) : Franz Weck

It is certified that error appears in the above-identified patent and that said Letters Patent is hereby corrected as shown below:

In claim 1, column 5, line 25, replace "detector piece" by --connector piece--.

Signed and Sealed this

Twenty-second Day of September, 1992

*Attest:*

DOUGLAS B. COMER

*Attesting Officer*

*Acting Commissioner of Patents and Trademarks*